United States Patent [19]

Bleyl et al.

[11] 3,937,334

[45] Feb. 10, 1976

[54] PIPE HANDLING DEVICE

[75] Inventors: Donald Louis Bleyl; John Dowe Irons, both of Houston, Tex.

[73] Assignee: Brown & Root, Inc., Houston, Tex.

[22] Filed: Feb. 3, 1975

[21] Appl. No.: 546,775

[52] U.S. Cl. ..... 214/2.5; 175/85

[51] Int. Cl.[2] ..... E21B 19/14

[58] Field of Search ..... 214/2.5; 175/85, 98

[56] References Cited

UNITED STATES PATENTS

| | | | |
|---|---|---|---|
| 3,561,616 | 2/1971 | Eddy | 214/2.5 |
| 3,805,902 | 4/1974 | Storm | 175/85 |

*Primary Examiner*—Philip Goodman

*Attorney, Agent, or Firm*—Kenway & Jenney

[57] ABSTRACT

A slant-type drilling rig assembly is disclosed having a pipe handling device which requires one operator during the transfer of conduit sections between an inclined drilling mast and a generally vertical conduit storage structure. The pipe handling device, or transfer apparatus, includes a pair of support columns having a horizontal structure connecting the upper end portion thereof. Freely suspended below the horizontal structure are an operator control station and an elevator. The elevator is connected to a fluid pressure operated means for raising and lowering which means is in turn connected to a fluid pressure actuated slidably mounted carriage. The transfer apparatus is pivotally mounted at its lower end for arcuate movement in a plane between the drilling mast and the pipe storage structure. During movement of pipe between the mast and the storage structure, the operator positioned in the operator control station is carried back and forth between the mast and the storage structure by the transfer appparatus so that the operator is available to perform such manual operations as may be necessary at both the mast and the storage structure.

16 Claims, 5 Drawing Figures

PIPE HANDLING DEVICE

BACKGROUND OF THE INVENTION

This invention relates generally to a slant-type drilling rig assembly for drilling boreholes having an inclined axis. More specifically, this invention relates to apparatus for transferring conduit sections between an inclined drilling mast and a structure for storing conduit sections in a generally vertical posture.

In the past, it has been known to use drilling rig assemblies in which an inclinable drilling mast may be positioned to obtain inclined boreholes and to permit a plurality of boreholes to be drilled from a single location. The desirability of having a plurality of boreholes is more readily visualized in the context of widely used off-shore drilling platforms.

Where inclined drilling masts are used, previously known conventional racking assemblies for conduit storage have proved to be unsatisfactory for a variety of reasons. Among the reasons is the fact that the inclined masts are preferably designed to operate in a plurality of positions with different angular relationship to a vertical direction. Accordingly, numerous alternate structures have been proposed to alleviate at least some of the disadvantages of theretofore known racking assemblies.

With the introduction of racking structures spaced from the drilling mast, there arose a need for suitable apparatus to transfer conduit sections composed of one or more joints of drill pipe back and forth between the racking structure and the drilling mast. In some of the known types of transfer apparatus, a shuttle, carriage, or the like has been used to transport a conduit section between an inclined mast and a vertical pipe storage area. Typically, these shuttle systems require cable systems of varying degrees of complexity to control movement of the shuttle between the mast and the storage area.

In addition, the shuttle systems generally require two workmen: one workman atop the storage area to position conduit sections therein and to connect conduit sections to the shuttle; one workman in the drilling mast to connect conduit sections with the shuttle and to connect conduit sections to a travelling block of the mast. It should be apparent that elimination of one workman would be advantageous both in the sense of dollar economy and of efficient personnel use.

Since some of the shuttle systems recognize the need for operating between various inclined positions, they have been provided with generally arcuate tracks on which the shuttle moves. Such curved tracks, however, are expensive to manufacture. Accordingly, some systems have suggested the use of straight tracks for the shuttle. However, straight tracks do not compensate for the vertically lower position which corresponding points of an inclined mast assume with respect to the storage area by virtue of the arcuate movement of the mast to the inclined position. Therefore, the straight track systems introduce additional complexity into their apparatus to accommodate for the vertical displacement of corresponding points.

Other known types of systems have employed catwalk structures of various designs which extend between the storage area and the inclined drilling mast. In use, a workman may physically push or guide the upper end of a conduit section during its transfer between the mast and storage. These catwalks may thus quickly lead to physical fatigue of the workman.

Another objectionable feature of the known transfer devices is that a catline is frequently used to move the lower end of the conduit from the mast to the storage area. Such catlines present danger to workmen on the deck of the drilling rig in addition to making the conduit transfer procedure more complex.

When dealing with horizontal conduit storage areas, pivotally mounted frames have also been used in the past to raise and lower conduit sections to mast structures for connection with other conduit sections. Such known pivotally mounted frames typically require two workmen: one in the storage area and one on the mast. Moreover, relatively large surface areas are required for pipe storage and for movement of the pivotally mounted frame.

Objects and Summary of the Invention

Accordingly, it is a general object of the present invention to provide a novel slant-type drilling rig having a pipe transfer mechanism which substantially eliminates the above and many other problems.

A more specific object of the present invention is to provide a novel conduit transfer apparatus for a slant-type drilling rig which lifts and transfers conduit sections between an inclined drilling mast and a generally vertical storage facility.

A further object of the present invention is to provide a novel conduit transfer apparatus for a slant-type drilling rig in which a single operator is suspended from the apparatus adjacent conduit grappling and lifting apparatus so that the single operator can effect the transfer of conduit sections between the inclined drilling rig and a generally vertical storage facility.

Yet another object of the present invention is to provide a novel conduit transfer apparatus for a slant-type drilling rig which does not physically inter-connect the inclined drilling rig and the conduit storage facility thereby facilitating inclined positioning of the drilling rig.

Still another object of the present invention is to provide a novel conduit transfer apparatus for use in a slant-type drilling rig which includes a carriage means for positioning a grappling means in proximity to the upper end portion of a conduit section to facilitate engagement thereof by the transfer means.

An inclined drilling rig which is intended to substantially accomplish at least some of the foregoing objects preferably includes a base having a drilling mast mounted thereon with means for positioning the drilling mast in an inclined relation to the base. Spaced from the drilling mast is a generally vertical conduit storage means having a plurality of storage locations, each of which may receive a conduit section for storage in a generally vertical posture. The conduit storage means is preferably disposed such that a medial plane thereof is generally coplanar with a vertical plane in which the axis of the drilling mast moves. The drilling rig is provided with a conduit transfer apparatus having a frame means which is pivotally mounted for arcuate movement parallel to the vertical plane about the lower portion of the generally vertical conduit storage means. The conduit transfer means also includes a substantially horizontal structure from which is suspended grappling means for engaging an upper end portion of a conduit section and an operator control station for carrying an operator.

The generally horizontal frame may be provided with a suitable guide means on which a carriage means is slidably mounted for movement generally perpendicularly with respect to the vertical plane. The carriage means may be provided with a universal joint from which means for raising and lowering the grappling means is freely suspended. Suitable conventional fluid pressure actuated devices may be used to move the carriage means with respect to the horizontal frame structure, to raise and lower the grappling means, and to move the conduit transfer apparatus between the generally vertical storage structure and the inclined mast.

BRIEF DESCRIPTION OF THE DRAWINGS

The above and many other objects of the present invention will be apparent to those skilled in the art when this specification is read in combination with the drawings wherein like reference numerals have been applied to like elements and wherein.

DESCRIPTION OF THE PREFERRED EMBODIMENT

Figures 1, 2:
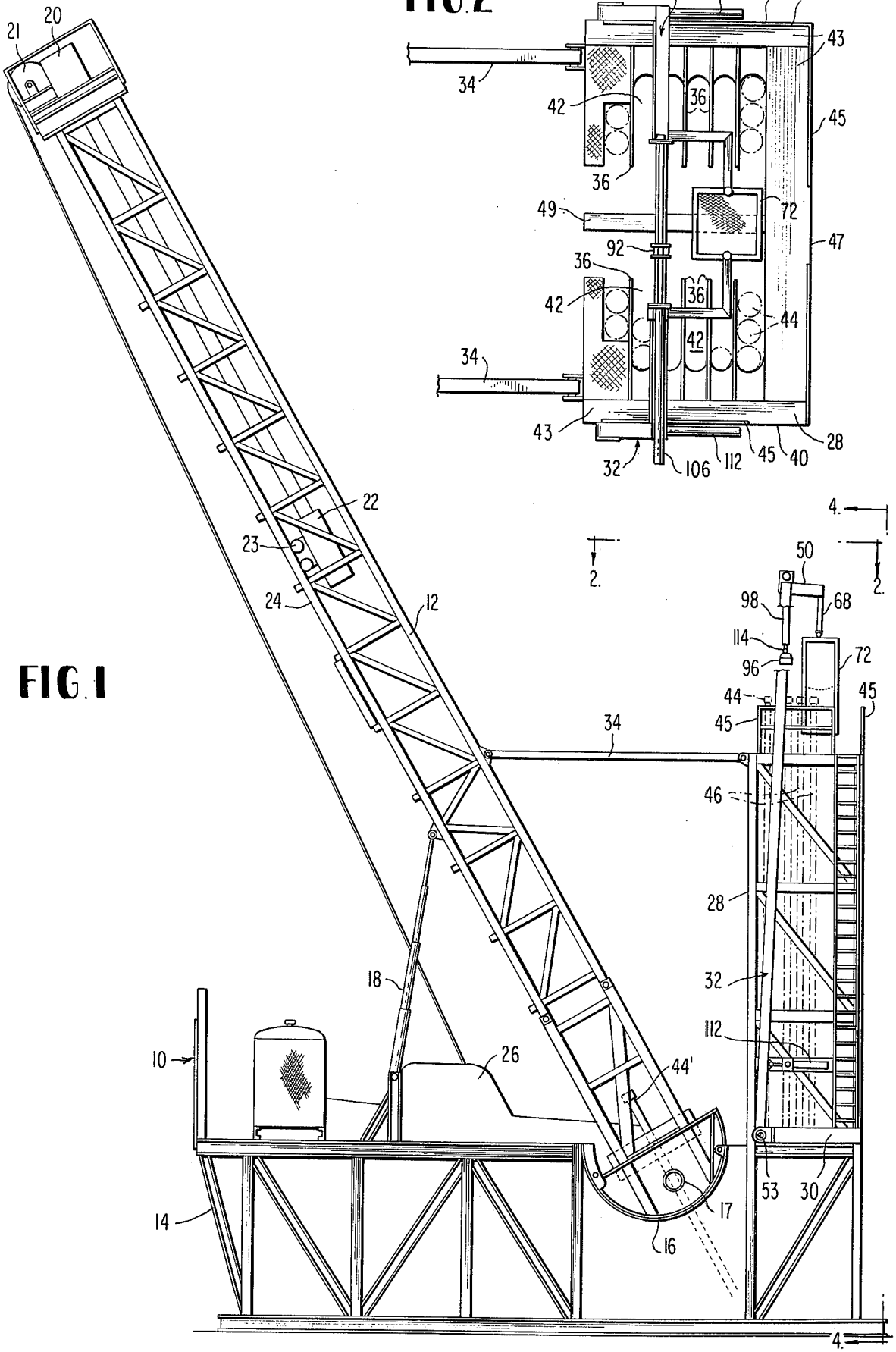
FIG. 1 is a partial elevation of an inclined drilling rig assembly having a generally vertical conduit storage means and a conduit transfer apparatus in accordance with the present invention.
FIG. 2 is a partial plan view taken along line 2—2 of FIG. 1 to illustrate details of the top portion of the conduit storage means.

Turning now to FIG. 1, a slant-type drilling rig assembly 10 is illustrated with drilling mast means 12 in an inclined position with respect to a base means 14. The lower end portion of the drilling mast 12 is supported with respect to the base means 14 by a rotatable bearing and support structure 16. In addition, fluid pressure operated drilling mast positioning means 18 connected to the drilling mast 12 and the base means 14 allows the mast 12 to be inclined in various positions with respect to the base means 14. The inclined mast 12, it will be noted, is adapted for arcuate movement in a generally vertical plane about the bearing structure 16.

In conventional drilling rigs drilling fluid passes downwardly through a drilling string and upwardly between the drilling string and a casing. Accordingly, the inclined rig is provided with an outlet 17 from which drilling fluid is returned to a shale shaker.

Positioned at the top of the drilling mast 12 is a crown block assembly 20 and a cable sheave 21. Mounted on the mast 12 for sliding motion with respect thereto, is a generally conventional travelling block 22 which may be provided with a hook assembly. The travelling block 22 may be mounted on rollers 23 that engage a suitable guide means 24 carried by the drilling mast 12 generally in accordance with U.S. Pat. No. 3,539,024 to Irons, Hester, Jr. and Bleyl.

Mounted on the base means 14 is a suitable drawworks 26 which is operably connected with the crown block 20 and the travelling block 22 for raising and lowering the travelling block 22 with respect to the drilling mast 12.

Further details of the drilling mast 12, the bearing assembly 16, the inclined slant-type drilling rig 10, and the travelling block guide means 24 will be found in U.S. Pat. No. 3,539,024 issued Nov. 10, 1970 to J. D. Irons, R. W. Hester, Jr., and D. L. Bleyl and assigned to the assignee hereof and the provisions of which are expressly incorporated herein by reference.

Positioned adjacent the lower end portion of the drilling mast 12 and spaced slightly therefrom is a generally vertical conduit storage structure or means 28. The conduit storage structure 28 has a lower portion 30 which is securely mounted on the base 14 of the drilling rig assembly 10. Preferably, a medial plane of the conduit storage structure 28 is coplanar with the vertical plane in which the axis of the drilling mast 12 moves. This positioning facilitates movement of conduit sections therebetween. Extending between an upper portion of the conduit storage structure 28 and an intermediate portion of the drilling mast 12 are a pair of mast support struts 34. The mast support struts 34 may be used to augment the drilling mast positioning means 18 in holding the mast 12 in a given inclined position. Turning now to FIG. 2 it will be apparent that the mast support struts 34 are generally parallel and are connected to corresponding sides of the conduit storage structure 28. Accordingly, the mast support struts 34 are also effective to provide protected movement for conduit sections between the conduit storage structure 28 and the drilling mast 12 as will become more apparent hereinafter.

The upper portion of the storage structure 28 is provided with a plurality of fingers 36 which extend generally horizontally inwardly from the lateral sides 38, 40 of the conduit storage structure 28. The plurality of fingers 36 define a plurality of conduit storage locations 42 which are adapted to receive an upper end portion 44 of conduit sections 46. Suitable catwalks 43 and safety fences 45 may be provided along the lateral sides 38, 40 and a closed side 47 of the storage structure 28 to facilitate personnel movements. If desired, a monkey board 49 may be provided for pipe transfer during conventional vertical drilling operations.

Pivotally mounted on the drilling rig 10 at a lower portion 30 of the storage means 28 is a conduit transfer means 32 which is operable to hold and to move conduit sections between the inclined mast 12 and the conduit storage structure 28.

Figure 3:
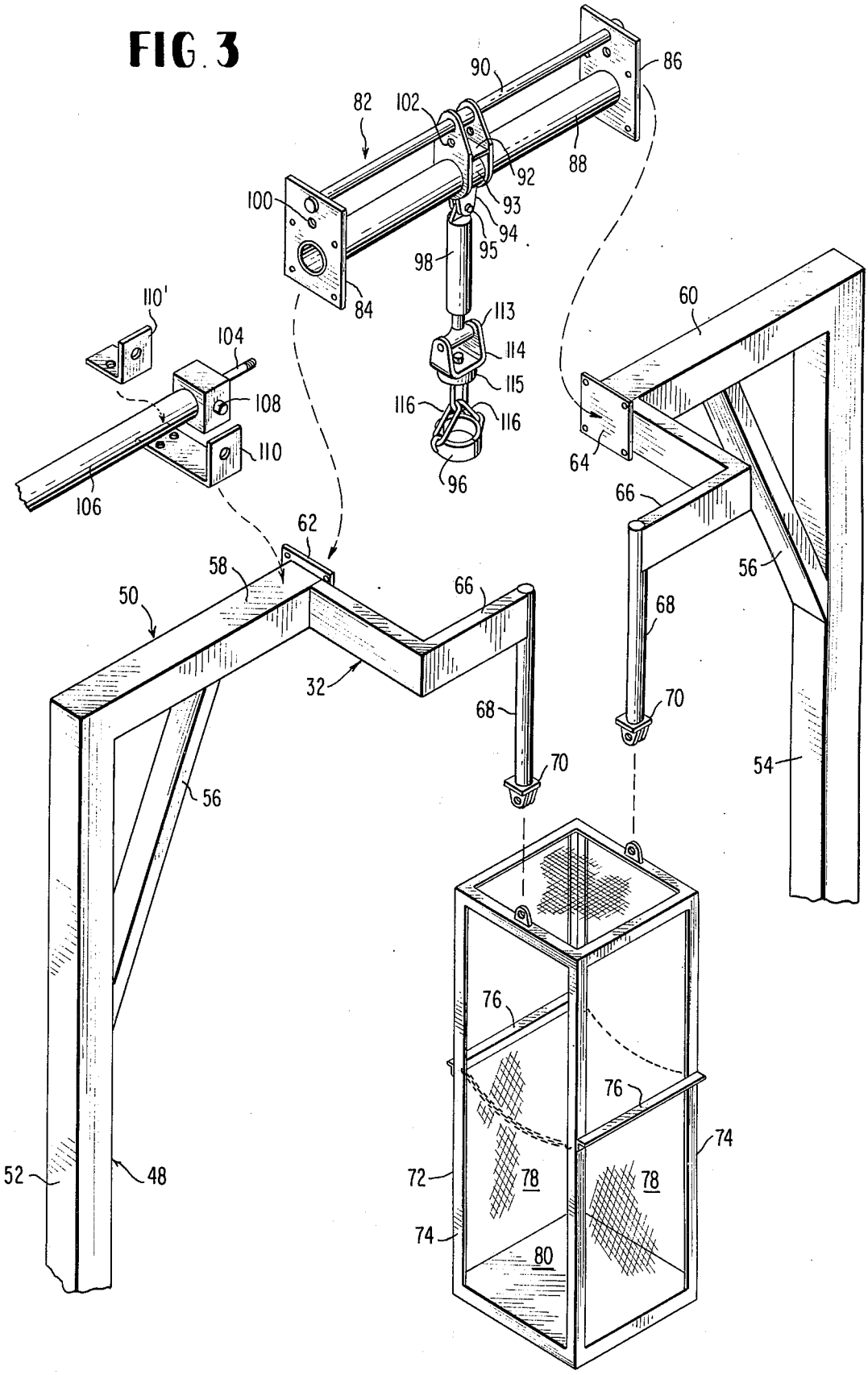
FIG. 3 is an exploded axonometric view of the conduit transfer apparatus of FIG. 1.

With reference now to FIG. 3, the details of the conduit transfer means 32 are more readily visualized. The conduit transfer means 32 includes a generally vertical frame means 48 and a generally horizontal structure 50.

The generally vertical frame portion 48 preferably comprises a pair of support columns 52, 54. The lower end of each support column 52, 54 is pivotally mounted to the lower portion of the conduit storage structure 30 as illustrated at 53 in FIG. 1. Returning to FIG. 3 the upper end portion of each column 52, 54 supports a corresponding end of the generally horizontal structure 50 and preferably includes a suitable conventional brace 56.

The generally horizontal structure 50 includes two generally colinear spaced apart sections 58, 60, each having a mounting bracket 62, 64 on adjacent ends thereof. Projecting generally horizontally from the adjacent end of each portion 58, 60 is a generally L-shaped member 66 having a generally vertically downwardly depending support 68 at one end thereof. The lower end of each support 68 is preferably provided with a securely attached clevis 70.

Each clevis 70 is adapted to receive and pivotally support an operator control station means 72 which is suspended therebelow in a trapeze-like manner for free swinging movement about a horizontal axis passing through the clevises 70.

The operator control station 72 may be fabricated from conventional angle irons and may be provided with open sides 74 and with front and rear sides 76, 78 partially enclosed by expanded metal material 78. A suitable floor 80 is provided on which an operator may stand.

The length of each supporting column 52, 54 is selected such that a vertical clearance will exist between the top of the storage structure 28 and the bottom 80 of the operator control station 72 (see FIG. 1).

Disposed between the mounting plates 62, 64 (see FIG. 3) of the horizontal structure 50 is a suitable conduit holding means 82 which is provided with suitable mating brackets 84, 86 that are connected to the mounting plates 62, 64 respectively. Between the mounting plates 84, 86 the conduit holding means includes a relatively large diameter guide means 88 and a smaller diameter means guide 90 which is disposed vertically thereabove. The guides 88, 90 may be fabricated from tubular stock and are adapted to slidably support a carriage means 92.

The lower portion of the carriage 92 preferably is provided with a universal joint 94 from which a grappling means is suspended. The joint 94 includes a collar portion 93 that is journaled about the guide 88 between fingers of the carriage 92 to permit free-swinging movement of the grappling means about a horizontal axis of the guide 88. The joint 94 also includes a clevis portion 95 having a clevis pin axis generally perpendicular to the horizontal axis of the guide 88 to permit free swinging movement of the grappling means in a transverse plane in which the horizontal axis lies.

The grappling means includes a conventional elevator 96 for engaging an upper end portion of a conduit section to be transferred. The grappling means also includes raising and lowering means 98 which may be connected at one end to the clevis portion 95 of universal joint 94 and at the other end to a clevis portion 113 of a swivel 114. The elevator 96 is suspended from a swivel portion 115 by a pair of links 116. The clevis portion 113 of the swivel 114 provides a second degree of freedom (the guide 88 being the first degree) for movement in a plane passing through the carriage 92. The lower portion 115 of the swivel 114 is free to rotate about an axis of the swivel thereby preventing torque from being transmitted to conduit sections carried by the elevator 96. The raising and lowering means preferably comprises a fluid pressure actuated cylinder which is operated from the operator control station 72.

In order to move the carriage 92 along the guides 88, 90, suitable translating means 106 is provided. A suitable hole 100 is provided in the mounting plate 84 and is disposed in general vertical alignment with the guide members 88, 90. Similarly, the carriage 92 is provided with a pair of holes 102 in general vertical alignment with the guide means 88, 90. The holes 100, 102 are adapted to receive a projecting piston rod 104 of the translating means 106 which may comprise, for example, a conventional fluid pressure operated cylinder. The hole 100 has a diameter greater than that of the piston rod 104 to accommodate relative motion between the plate 84 and the piston rod 104. The holes 102 provide suitable access for securely connecting the piston rod 104 to the carriage 92.

The translating means 106 is provided with trunions 108 on each side thereof which are adapted to be mounted in L-shaped brackets 110. The L-shaped brackets 110 are mounted on the free end of the horizontal member 58 adjacent the mounting bracket 62 such that the entire stroke of piston rod 104 may be used to move the carriage 92. The translating means 106 is effective to reciprocate the piston rod 104 and thereby move the carriage 92 longitudinally along the guides 88, 90 to facilitate positioning the elevator 96 is proximate relation to an upper end portion of a conduit section.

Figure 4:
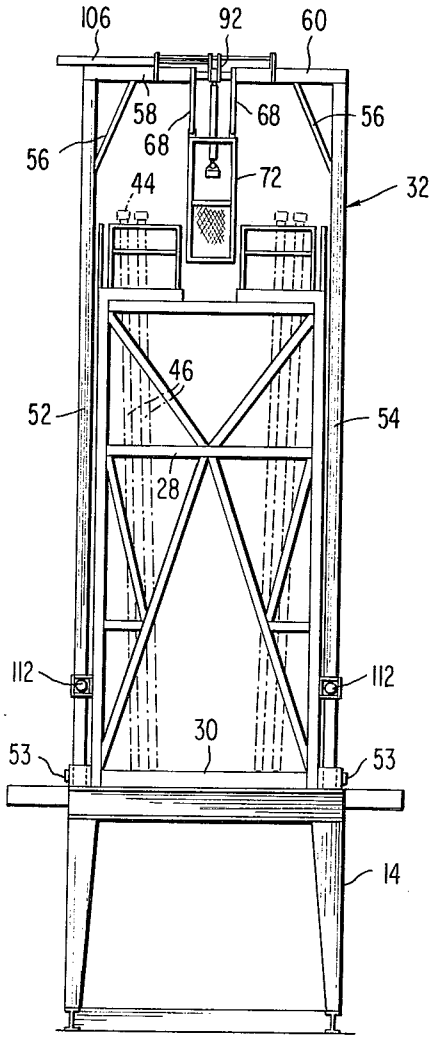
FIG. 4 is a partial endwise elevation of the conduit storage means and the conduit transfer apparatus taken along line 4—4 of FIG. 1 to illustrate the conduit transfer apparatus in a position adjacent the conduit storage facility.

Turning now to FIG. 4, the conduit transfer means 32 is illustrated in a position adjacent to the conduit storage structure 28. Each support column 52, 54 is provided adjacent its lower end with a suitable longitudinal positioning means 112 which may take the form of a suitable conventional fluid pressure operated cylinder. The longitudinal positioning means 112 (see FIG. 5) is effective to move the pipe transfer apparatus 32 between the position adjacent the drilling mast 12 and another position adjacent the pipe storage structure 28 depicted in FIG. 5. The fluid pressure operated cylinder 112 is pivotally connected to the corresponding vertical support column 52, 54 and to the corresponding side of the pipe storage structure 28.

OPERATION

The conduit transfer apparatus of this invention is advantageously used during a "trip" in which a drill string is removed from and replaced into the well bore, such as when it becomes necessary to change a drill bit. During such a trip, the travelling block 22 (see FIG. 1) is lowered until it engages the projecting end 44' of a conduit section of the drill string or conduit. The travelling block 22 is then connected to the projecting end 44' and is raised up the drilling mast 12 until a conduit section has been exposed. Conventional slips may then be used to engage the next lower conduit section and thereby prevent it from slipping down the borehole.

The exposed conduit section is then removed from the projecting end 44 of the next lower section and engaged by the elevator 96 carried by the previously positioned conduit transfer means 32. The engagement by the elevator 96 may be facilitated by an operator in the operator control station 72. The conduit transfer means 32 is then pivotally swung in an arcuate plane by the positioning means 112 back towards the conduit storage structure 28. The raising and lowering means 98 is actuated to raise the conduit section 46 so that its lower end portion is free of the support provided by the projecting end 44'. Meanwhile, the travelling block 22 may be lowered into engagement with the projecting end 44' of the next lower conduit section of drill conduit.

Figure 5:
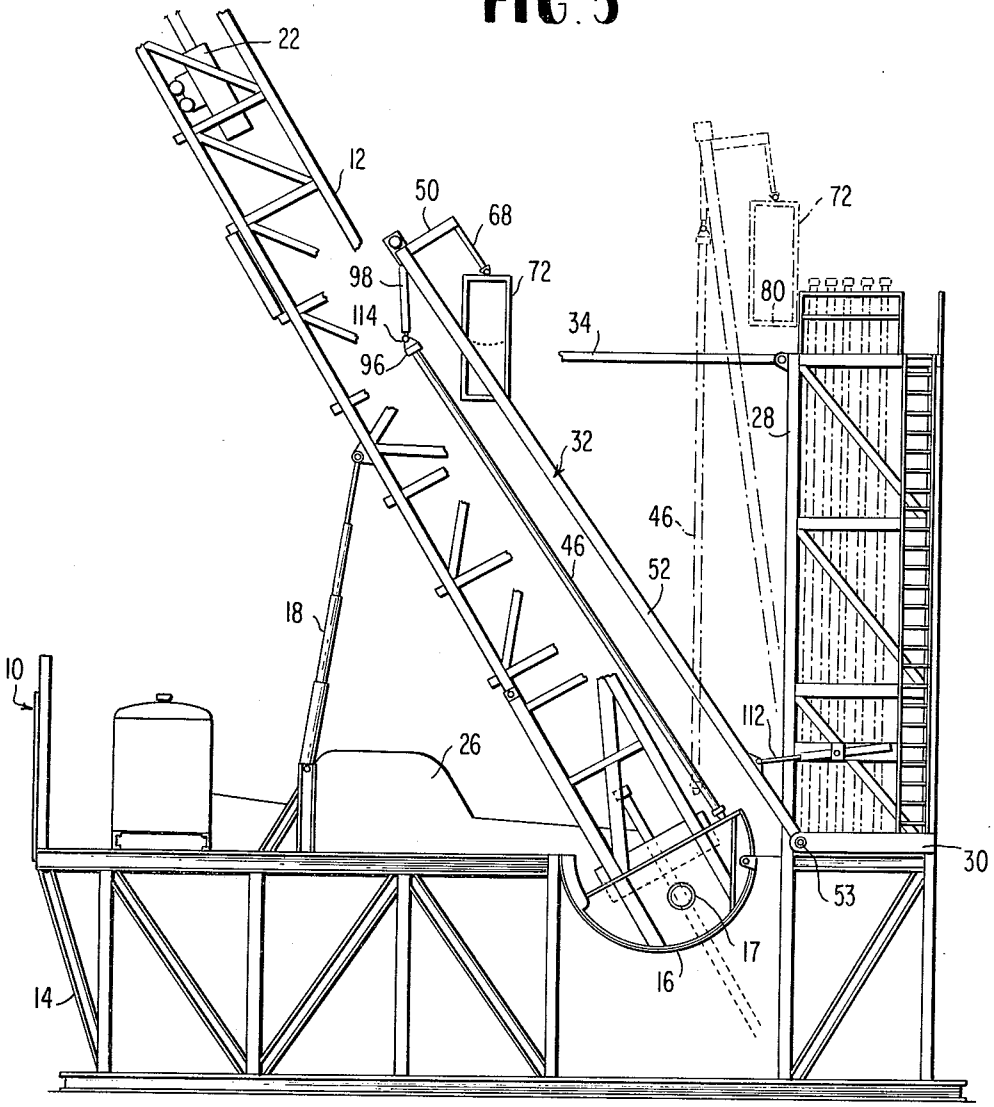
FIG. 5 is a partial elevational view similar to that of FIG. 1 with portions of the mast structure broken away to illustrate the conduit transfer apparatus in a position adjacent the drilling mast.

In the posture of the conduit transfer means 32 depicted by broken lines in FIG. 5, the operator control station 72 and the pipe section 46 are both allowed to be freely suspended from the generally horizontal structure 50 of the conduit transfer means. The conduit transfer means 32 is continually moved until is assumes a position adjacent the conduit storage structure 28 (see FIG. 1). The elevator 96 is lowered by the raising and lowering means 98 until the bottom end of pipe section 46 is supported by a suitable support such as the bottom of the storage structure 28. The upper end portion 44 of the conduit section 46 is then positioned in one of the plurality of conduit storage locations 42 (see FIG. 2) of the conduit storage structure 28. The elevator 96 is then released from the conduit section 46 and the conduit transfer means 32 is returned to the drilling mast 12 to handle the next conduit section.

It may be noted here that the drilling mast means 12 may be provided with a transfer mechanism for engaging a lower end portion of a conduit section, when disconnected from the drill string, in order to move the lower end portion toward the storage structure 28. An example of such a transfer mechanism is found in FIGS. 2 and 8 of the Irons et al patent (U.S. Pat. No. 3,539,024).

When it is desired to insert a drill string into a bore, the above procedure is reversed. The pipe transfer means 32 is positioned in vertically proximate relation with the upper end portion 44 of a conduit section 46 which is to be transferred from the storage structure 28 to the drilling mast 12. More specifically, the elevator 96 is positioned in a second generally vertical plane perpendicular to the first vertical plane containing the inclined drilling mast 12 and the pipe storage structure 28. The second generally perpendicular plane includes both the upper end portion 44 of the conduit section 46 and the elevator 96.

The cylinder 106 is then actuated to translate the carriage 92 transversely of the generally horizontal structure 50 such that the elevator 96 is brought into general vertical alignment with the upper end portion 44 of the conduit section 46 to be transferred. With the elevator 96 in general vertical alignment with the upper end portion 44, the raising and lowering means 98 is actuated to lower the elevator 96 into proximity with the upper end portion 44 of the conduit section 46.

An operator carried by the control station 72 may then connect the elevator with the upper end portion 44. With the elevator 96 connected to the conduit section 46, the raising and lowering means 98 is actuated to raise the conduit section 46 vertically upwardly such that a clearance exists between the lower end portion of the conduit section 46 and a support, such as the bottom of the storage structure 28.

The cylinder 106 is then actuated to return the carriage 92 and the elevator 96 to the generally medial plane of the pipe storage structure 28. Subsequently, the conduit transfer means 32 is arcuately moved to the configuration illustrated by the broken lines in FIG. 5. The conduit section 46 is then lowered until the lower end thereof engages a support, such as the projecting end 44' of another conduit section. The conduit transfer means 32 is then rotated further until the upper end portion 44 of the conduit section 46 and the elevator 96 are in general proximity to the travelling block 22 of the mast 12 (solid lines FIG. 5). The travelling block 22 is then engaged with the upper end portion 44 of the conduit section 46 and the elevator 96 is released. The operator in the operator control station 72 and the conduit transfer apparatus 32 are then returned to the storage structure 28 to pick up another conduit section.

The travelling block 22 supports the conduit section 46 while it is connected to the projecting end 44' of conduit already in position in the well bore. Subsequently, the newly added conduit section 46 is lowered by the travelling block 22 into the well bore in preparation for another conduit section.

While the conduit transfer means 32 has been described as including a horizontal structure 50, it will be apparent to those skilled in the art that the conduit transfer means might also be designed with the conduit holding means pivotally connected thereto along a suitable first horizontal axis. In this manner, the conduit holding means and an associated conduit section will be mounted for free swinging movement during conduit transfer such that a generally vertical orientation is assumed, as in the embodiment described above.

Similarly, the operator control station means 72 may be pivotally connected to the conduit transfer means along a suitable second horizontal axis for free swinging movement during conduit transfer such that a generally vertical orientation is assumed thereby.

Summary of the Advantages

One advantageous facet of an inclined drilling rig assembly according to the preferred embodiment of the invention relates to the requirement of only one workman to effect the conduit transfer operation between the inclined drilling mast and the conduit storage structure.

Another advantage of the present invention is that workmen are not required to traverse a catwalk between spaced vertical locations and to move conduit sections while so walking.

Another advantageous aspect of this invention is that an operator of the conduit transfer apparatus is always close to the elevator and may readily spot any malfunctions.

Still another advantage of the present invention is that the need for curved tracks, straight tracks, or catwalks physically interconnecting the inclined drilling mast and the conduit storage structure are eliminated thereby facilitating adjustment of the mast inclination as desired.

A further advantage of the present invention is that the conduit transfer apparatus can be readily adapted to conduits of varying diameter by changing the elevators 96 suspended therefrom.

Yet another advantage of the present invention is that cable-operated systems and the problems associated therewith are substantially eliminated by employing a fluid pressure operated system.

Another advantage of the present invention is that the operator control station is continually on the storage structure side of the conduit sections thus providing a safer position for the operator in the event that a conduit section should inadvertently become disengaged from the elevator.

A further desirable aspect of the present invention is the use of a vertical storage structure for conduit sections which enables the most economical use of available surface area on the drilling rig assembly.

It is now apparent that there has been provided in accordance with this invention, a slant-type drilling rig assembly having a pipe transfer means that substantially fulfills the objects and advantages set forth above. Although the present invention has been described in conjunction with a specific embodiment thereof, it is evident that many alternatives, modifications, variations and equivalents will be apparent to those skilled in the art in light of the foregoing disclosure of the invention. Accordingly, it is expressly intended that all such alternatives, modifications, variations and equivalents which fall within the spirit and scope of the invention as defined in the appended claims, be embraced thereby.

What is claimed is:

1. In a slant-type drilling rig assembly having a base, a generally vertical conduit storage means, drawworks, drilling mast positioning means, and an inclinable drilling mast with a crown block, travelling block, and guide means therefor, an improved conduit transfer apparatus for moving conduit sections between the inclinable drilling mast and generally upright storage positions in the conduit storage means, comprising:

frame means being pivotally mounted to the drilling rig assembly and operable to move between a position adjacent the conduit storage means and another position adjacent the drilling position adjacent the drilling mast;

conduit holding means having a grappling means suspended therefrom, being pivotally attached to the frame means on a horizontal axis, and being operable to engage an upper portion of a conduit section during transfer between the conduit storage means and the drilling mast whereby the conduit holding means and an associated conduit section are free swinging with a generally vertical orientation during conduit transfer; and operator control station means suspended from the frame means for trapeze-like movement relative thereto about a horizontal axis, being operable to support and carry an operator for the conduit transfer apparatus and having a generally vertical orientation during conduit transfer.

2. The slant-type drilling rig assembly of claim 1 wherein the conduit holding means includes carriage means slidably mounted on a guide and being operable for movement transversely of a vertical plane including the drilling mast and the conduit storage means.

3. The slant-type drilling rig assembly of claim 1 wherein the grappling means includes means for raising and lowering a portion of the grappling means relative to the frame means.

4. The slant-type drilling rig assembly of claim 1 wherein the frame means includes a horizontal structure and a pair of generally vertical support columns, one end of each column being pivotally connected to the drilling rig assembly adjacent a corresponding side of the conduit storage means, the other end of each column carrying the horizontal structure, and each column having a length greater than the height of the conduit storage means such that the operator control station means has vertical clearance with the top of the pipe means.

5. The slant-type drilling rig assembly of claim 4 wherein the frame means includes fluid pressure actuated swinging means for pivoting the frame means between the drilling mast and the conduit storage means.

6. The slant-type drilling rig assembly of claim 5 wherein the conduit holding means includes:

carriage means having fluid pressure operated means for translating the carriage means transversely of a vertical plane including the drilling mast and the conduit storage means; and fluid pressure operated means for raising and lowering the grappling means relative to the horizontal structure.

7. A slant-type drilling rig assembly for drilling boreholes having an inclined axis comprising:

base means;

drilling mast means mounted on the base means for arcuate movement in a vertical plane and having a crown block, a travelling block, and guide means for the travelling block;

drilling mast positioning means connected to the base means and operable to position the drilling mast means in any of a plurality of inclined positions in the vertical plane;

drawworks mounted on the base means and operably connected with the crown block and the travelling block to raise and lower the travelling block with respect to the drilling mast means;

a generally vertical conduit storage means having a plurality of storage locations, being mounted on the base means in the vertical plane and operable to store conduit sections in a generally vertical posture;

frame means having a generally horizontal structure, being pivotally mounted to a lower portion of the conduit storage means for arcuate movement between the conduit storage means and the drilling mast means;

conduit holding means having grappling means freely suspended therebelow, being attached to the generally horizontal structure, and being operable to engage an upper portion of a conduit section during transfer thereof between the conduit storage means and the drilling mast means;

control station means being freely suspended below the generally horizontal structure for motion with respect thereto and being operable to support an operator for the frame means.

8. The slant-type drilling rig of claim 7 wherein the conduit holding means includes:

carriage means from which the grappling means is freely suspended, being operable for sliding movement in a direction generally perpendicular to the vertical plane; and reciprocating means connected to the horizontal structure and to the carriage means and being operable to slide the carriage means.

9. The slant type drilling rig of claim 8 wherein the reciprocating means comprises a fluid pressure actuated cylinder.

10. The slant-type drilling rig of claim 7 wherein the grappling means includes:

an elevator operable to engage the upper end of a conduit section; and powered means for raising and lowering the elevator relative to the horizontal structure, having one end freely suspended from the conduit holding means and the other end connected to the elevator.

11. A slant-type drilling rig assembly for drilling inclined boreholes comprising:

base means;

drilling mast means mounted on the base means for arcuate movement in a vertical plane and having a crown block, a travelling block, and guide means for the travelling block;

drilling mast positioning means connected to the base means and operable to position the drilling mast means in any of a plurality of inclined positions in the vertical plane;

drawworks mounted on the base means and operably connected with the crown block and the travelling block for raising and lowering the travelling block;

generally vertical pipe storage structure having a plurality of storage locations and a bottom portion connected to the base means, being disposed in the vertical plane and operable to store pipe sections in a generally vertical posture; and pipe transfer means for moving pipe sections between the pipe storage structure and the drilling mast means including a generally horizontal structure disposed generally perpendicularly with respect to the vertical plane, a carriage guide endwise supported by the horizontal structure and generally perpendicular to the vertical plane, a carriage slidably mounted on the carriage guide and having a universal joint suspended therebelow, fluid pressure actuated means connected to the horizontal structure and the carriage and operable to move the carriage, an elevator, fluid pressure actuated means connected at one end to the universal joint, carrying the elevator at the other end and being operable to raise and lower the elevator, a control station suspended below the horizontal structure and operable to support an operator, a pair of support columns, each column having one end pivotally mounted to a corresponding side of the pipe storage structure for arcuate movement in a plane parallel to the vertical plane, having the other end attached to a corresponding end of the horizontal structure, and having a length exceeding the height of the pipe storage structure such that vertical clearance exists between the top of the pipe storage structure and the bottom of the control station, and fluid pressure means connected to the pipe storage structure and one of the support columns for moving the support columns between a position adjacent the pipe storage structure and another position adjacent the drilling mast means.

12. A method of transferring conduit sections between an inclined drilling mast and a generally vertical conduit storage means comprising:

positioning a grappling means of a transfer means in proximate relation with an upper end portion of a conduit section to be transferred;

gripping the upper end portion of conduit section with the grappling means;

raising the conduit section such that vertical clearance is attained between the lower end portion thereof and a first support;

allowing the grappling means to hang freely below the transfer means;

pivotally swinging the transfer means with the grappling means and an operator control station suspended therefrom between the drilling mast and the pipe storage structure;

lowering the grappling means until the lower end portion of the pipe section engages a second support; and releasing the grappling means from the upper end portion of the conduit section.

13. The method of claim 12 further including:

returning the transfer means for positioning the gripping means in general vertical alignment with another conduit section to be transferred between the drilling mast and the pipe storage means.

14. The method of claim 12 wherein the positioning includes:

moving the transfer means in a vertical plane defined between the drilling mast and the pipe storage structure until the grappling means lies in a second vertical plane perpendicular to the first vertical plane, the conduit section being in the second plane;

sliding a carriage of the transfer means from which the grappling means is suspended in the second vertical plane until general vertical alignment exists between the grappling means and the upper end portion of the conduit section; and lowering the grappling means from the transfer means toward engagement with the upper end portion.

15. A method of transferring conduit sections between an inclined drilling mast and a generally vertical pipe storage means requiring one operator, comprising:

providing a transfer means from which an operator control station and a grappling means are freely suspended;

positioning the grappling means in proximate relation to the upper end portion of a conduit section to be transferred;

gripping the upper end portion with the grappling means;

raising the conduit section such that vertical clearance is attained between the lower end portion thereof and a first support;

pivotally swinging the transfer means with the grappling means and the operator control station between the drilling mast and the pipe storage means;

lowering the grappling means until the lower end portion of the conduit section engages a second support; and releasing the upper end portion of the conduit section.

16. The method of claim 15 wherein the positioning step comprises:

moving the transfer means in a vertical plane defined between the drilling mast and the pipe storage means until the grappling means lies in a second vertical plane perpendicular to the first vertical plane and in which the upper end portion is disposed;

moving the grappling means in the second vertical plane relative to the transfer means until general vertical alignment exists between the grappling means and the upper end portion; and lowering the grappling means from the transfer means into proximate relation with the upper end portion.

* * * * *